US009022259B2

(12) United States Patent
Breier

(10) Patent No.: US 9,022,259 B2
(45) Date of Patent: May 5, 2015

(54) GARMENT FOLDING APPARATUS

(71) Applicant: Harold Breier, Brooklyn, NY (US)

(72) Inventor: Harold Breier, Brooklyn, NY (US)

( * ) Notice: Subject to any disclaimer, the term of this patent is extended or adjusted under 35 U.S.C. 154(b) by 0 days.

(21) Appl. No.: 13/890,895

(22) Filed: May 9, 2013

(65) Prior Publication Data

US 2014/0158723 A1 Jun. 12, 2014

Related U.S. Application Data

(60) Provisional application No. 61/683,032, filed on Aug. 14, 2012.

(51) Int. Cl.
*D06F 89/02* (2006.01)
*A41H 33/00* (2006.01)

(52) U.S. Cl.
CPC ..... *D06F 89/023* (2013.01)

(58) Field of Classification Search
CPC ..... D06F 89/02; D06F 89/005; A41H 33/00
USPC ..... 223/37–43, 52.2; D20/42
See application file for complete search history.

(56) References Cited

U.S. PATENT DOCUMENTS 1,657,551 A 1/1928 Schremp
2,386,660 A * 10/1945 Clayton ..... 112/323
3,689,059 A 9/1972 Gross
3,989,172 A 11/1976 Wiedemann et al.
4,648,861 A 3/1987 Pierce
5,011,052 A 4/1991 Craig
5,131,574 A 7/1992 Usco et al.
5,154,329 A 10/1992 Dorfmueller
5,417,351 A 5/1995 Grosz
5,417,641 A 5/1995 Warren
D403,709 S * 1/1999 Norwood ..... D20/42
5,947,349 A 9/1999 Shaalan
5,961,033 A * 10/1999 Wang ..... 229/87.17
6,015,069 A * 1/2000 Christensen ..... 223/37
6,287,659 B1 * 9/2001 Robbins et al. ..... 428/43
6,360,927 B1 3/2002 Barker
6,685,065 B1 * 2/2004 Ebling et al. ..... 223/38
6,814,269 B1 * 11/2004 Fernandez ..... 223/37

* cited by examiner

*Primary Examiner* — Ismael Izaguirre
(74) *Attorney, Agent, or Firm* — Cozen O'Connor

(57) ABSTRACT

A garment folding apparatus includes a planar center panel having a length and a width, the width being less than the length. The center panel is configured to fold in a lengthwise direction. The apparatus further includes a planar left side panel joined by a hinge to the center panel. The apparatus further includes a planar right side panel joined by a hinge to the center panel on a side opposite to the left side panel. The left side panel and the right side panel each comprise raised handle portions on an outer edge thereof. When the left side panel and the right side panel are folded onto the center panel, the handle portions fit into corresponding notches formed in side edges of the second portion of the center panel and corresponding notches formed in inner side edges of the left side panel and the right side panel.

11 Claims, 6 Drawing Sheets

100
305, 310

120, 130
140
117
117
410
410
420
420

GARMENT FOLDING APPARATUS

CROSS-REFERENCE TO RELATED APPLICATIONS

This application claims the benefit of U.S. Provisional Patent Application No. 61/683,032, filed on Aug. 14, 2012, which is hereby incorporated by reference in its entirety.

FIELD OF THE INVENTION

The disclosed embodiments relate to a garment folding apparatus. In particular, the disclosed embodiments relate to a garment folding apparatus having a center panel and two side panels on which upper-body garments, such as a shirts and tops, are laid to be folded. The side panels fold over onto the center panel to accurately and consistently fold the garments.

BACKGROUND OF THE INVENTION

Households, especially those with large families, must launder a large quantity of garments each week. Folding the laundry can be a very time-consuming chore, so a device which assists in the folding process would be a welcome addition to the household laundry equipment, particularly if it is inexpensive, easy to use, and easy to store when not in use. Moreover, folding laundry in a uniform manner, with the help of a folding device, can help make more efficient use of limited clothing storage space.

Clothing stores typically display upper-body garments, such as shirts and tops, on display shelves in a folded configuration. It is important from a merchandising standpoint for these displays to look neat and uniform. Folding such garments in a uniform and consistent manner can be difficult and time-consuming. Furthermore, in a store setting, customers are constantly rummaging through stacks of garments to find desired sizes and colors. This results in the uniform displays constantly being rearranged and messed up.

It is difficult for store personnel to consistently and uniformly fold garments without some sort of apparatus to provide guidance, because each garment may be folded along slightly different lines, which results in a non-uniform appearance when the garments are stacked. Moreover, each individual performing the folding may have a slightly different idea of how to fold the garments. A folding guide or apparatus must be lightweight and compact when not in use. The apparatus must also be inexpensive so that the store can provide numerous available devices to allow the employees to fold clothes quickly and easily without having to search around the store for a device.

Conventional tri-fold apparatuses for folding shirts and tops may lie flat on a surface, which makes it difficult to lift the side panels by their outer edges to fold the garment. Certain conventional apparatuses provide feet which extend downward in the corners of the panels to raise the apparatus off of a surface. However, because of the soft and highly flexible nature of these conventional apparatuses, the outer edges of the side panels may sag and contact the surface, making them difficult to grasp easily.

SUMMARY OF THE INVENTION

In one aspect of the disclosed invention, a garment folding apparatus includes a planar center panel having a length and a width, the width being less than the length. The center panel is formed of a first portion and a second portion joined by a hinge configured to fold the center panel in a lengthwise direction.

The apparatus further includes a planar left side panel having a length and a width, the width being less than the length. The left side panel is joined by a hinge to the first portion of the center panel. The left side panel is positioned so that the length thereof is parallel to the length of the center panel.

The apparatus further includes a planar right side panel having a length and a width, with the width being less than the length. The right side panel is joined by a hinge to the first portion of the center panel on a side opposite to the left side panel. The right side panel is positioned so that the length thereof is parallel to the length of the center panel.

The left side panel and the right side panel each comprise raised handle portions on an outer edge thereof. When the left side panel and the right side panel are folded onto the center panel, the handle portions fit into corresponding notches formed in side edges of the second portion of the center panel and corresponding notches formed in inner side edges of the left side panel and the right side panel.

Embodiments of the disclosed invention may include one or more of the following features. The left and right side panels may include a number of apertures formed therein to allow air to pass through the panels as they are moved to an unfolded position. The center panel may include a hanging slot to allow the apparatus to be hung from a hook or projection without having an element which extends from the center panel. The left and right side panels may have corresponding hanging slots which align with the hanging slot of the center panel when the left and right side panels are in the folded position.

BRIEF DESCRIPTION OF THE DRAWINGS

The above and/or other aspects and advantages will become more apparent and more readily appreciated from the following detailed description of the disclosed embodiments taken in conjunction with the accompanying drawings of which.

DETAILED DESCRIPTION OF THE DRAWINGS

Figure 1:
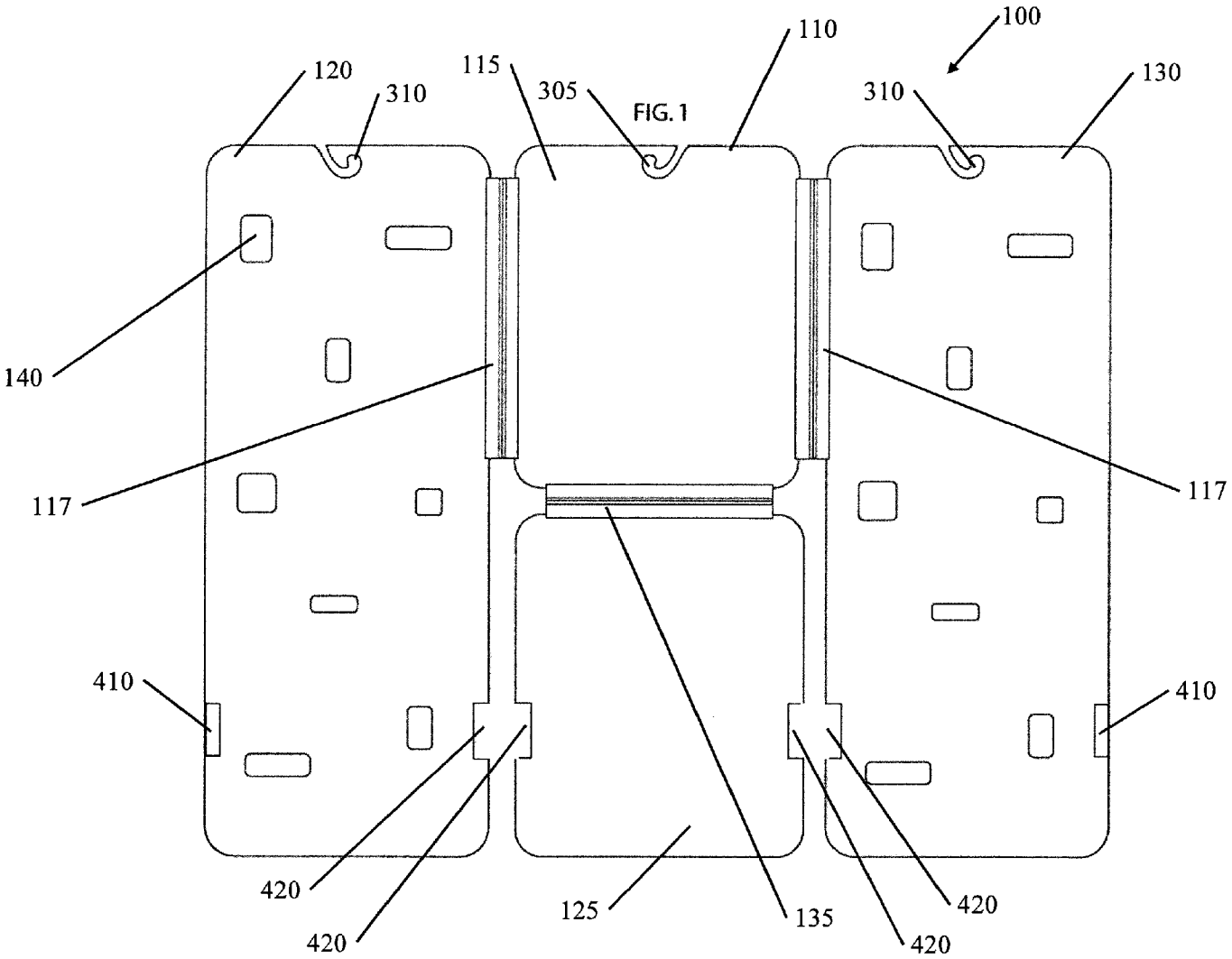
FIG. 1 is a front plan view of an embodiment of a garment folding apparatus.
Figure 2:
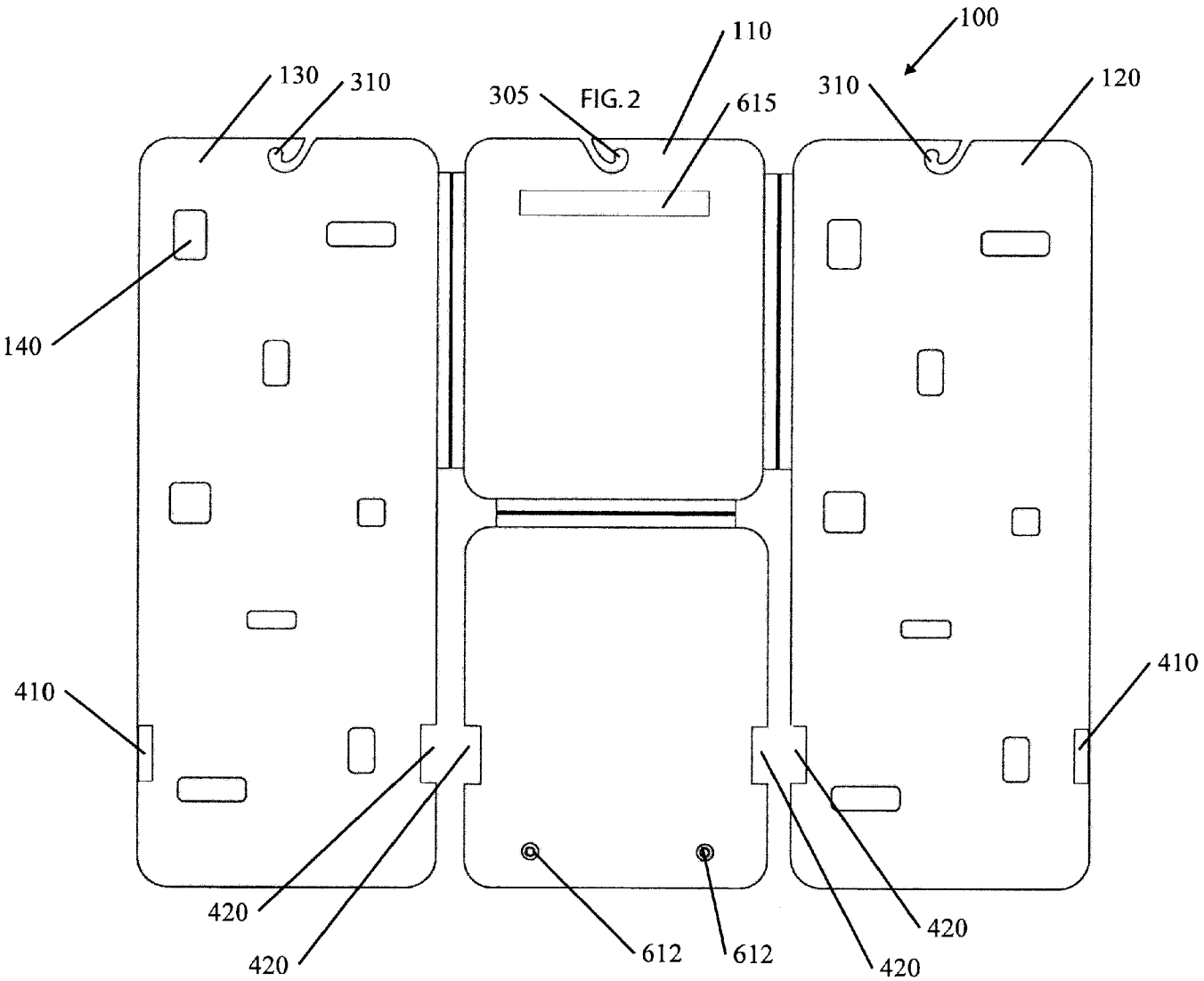
FIG. 2 is a back plan view of the garment folding apparatus.

FIGS. 1 and 2 show a front view and a back view, respectively, of an embodiment of the garment folding apparatus 100, which has a tri-fold configuration with three connected planar panels. Each panel may be about 9 inches wide by about 24 inches long. A center panel 110 has a top portion 115 which is connected on side edges thereof by hinges 117 to two side panels, i.e., a left side panel 120 and right side panel 130. The panels are thin, e.g., between about 2.8 and 3.5 mm, and flat and may have a substantially rectangular shape, e.g., they may be rectangular with rounded corners. The center panel 110 may be formed of two separate panels, i.e., the top portion 115 and a bottom portion 125, joined by a hinge 135 which allows the center panel to fold in the lengthwise direction. The bottom portion 125 of the center panel 110 is not directly connected to the side panels (120 and 130).

The apparatus 100 may be formed of a lightweight, flexible material, e.g., plastic, by an injection molding or a stamping process. The panels (110, 120, and 130) thus formed are flexible but have some rigidity so that the apparatus does not become too "flimsy" to allow for proper handling and operation of the apparatus. Less flexible materials, such as harder plastics, may also be used. The hinges (117 and 135) may be formed of the same material as the panels and may include a region of increased flexibility in a center portion thereof to allow the side panels (120 and 130) to be folded onto the center panel (110). For example, a linear portion at the center of the hinge (117 and 135) may be thinner than the connecting portions of the hinge and may have a curved cross-section. The connecting portions of the hinge (117 and 135) may be of the same thickness as the panels (110, 120, and 130) and may be constituted by an extended portion of each of the panels being connected. The combined width of the apparatus, i.e., the combined width of center panel 110, side panels (120 and 130), and spaces therebetween, may be about 28 inches, which is more than the length of these panels (about 24 inches).

To use the garment folding apparatus, the apparatus is typically positioned on a flat surface, such as a table or counter, in a flat, i.e., unfolded configuration. Although, it is also possible to use the apparatus on surfaces which are not entirely flat, e.g., on top of a stack of clothing on a display table.

Figure 3A:
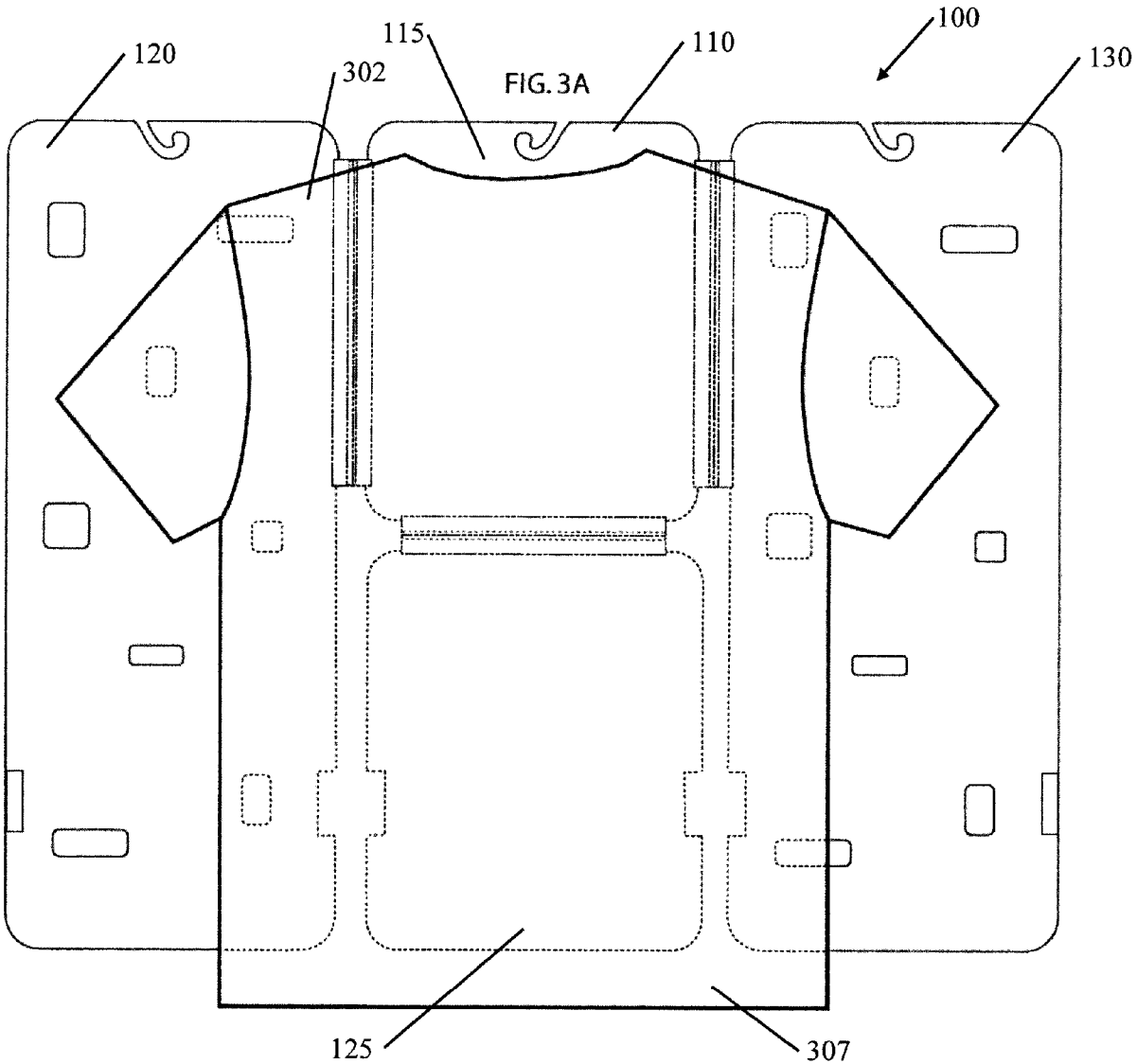
FIG. 3A is a front plan view of the garment folding apparatus with a garment positioned thereon for folding.

As shown in FIG. 3A, to fold a garment, e.g., a T-shirt 302, the shirt is placed on the front surface of the apparatus so that the T-shirt 302 is approximately centered on the apparatus 100 in the width direction and so that the neck of the garment is approximately even with, or slightly below, the top edge (at ref. no. 110) of the center panel 110. If the T-shirt 302 is longer than the length of the panels (e.g., about 24 inches), then the bottom edge 307 of the T-shirt 302 may be folded onto the body of the T-shirt so that the bottom edge 307 of the T-shirt 302 is even with the bottom edge (at ref. no. 125) of the center panel 110.

Each of the side panels (120 and 130), one at a time, is folded onto the center panel (110) together with the portion of the garment which is covering each side panel (120 and 130) and then returned to its original unfolded position without the garment. This leaves the side edge and sleeve portions of the T-shirt 302 folded on the body of the T-shirt 302. The folding step may be repeated for whichever of the side panels was folded first, i.e., the left or right side, in order to fold the opposite side sleeve of the shirt if the sleeves are too long to be fully folded in a single iteration (i.e., if the sleeves extend beyond the width of the device). The bottom portion 125 of the center panel 110, i.e., the hinged portion which is not connected to the side panels, is then folded onto the top portion 115 of the center panel 110 with its portion of the garment and then returned to its original position without the garment. This leaves the bottom portion of the shirt folded onto the body of the shirt, thereby resulting in a uniformly folded garment in a size and shape approximating the size and shape of the top portion 115 of the center panel 110, the portion of the center panel which is hinged to the side panels.

Referring again to FIGS. 1 and 2, the side panels (120 and 130) may include an arrangement of apertures 140 which allow air to infiltrate between the garment and the side panels during the step in which the panels are returned to their original, unfolded position without the garment. Apertures 140 may also be provided on the bottom portion 125 of the center panel 110. The apertures 140 allow the garment to separate more easily from the panels as they are returned to the unfolded position, because the apertures help prevent the formation of suction forces between the panels and the garment. These suction forces tend to keep the garment attached to the panel which may prevent proper folding of the garment. For example, a shirt may remain attached to a side panel (120 and 130) during the movement of the side panel (120 and 130) back to the unfolded position, which may cause the shirt to drop off of the side panel (120 and 130) into an uneven arrangement on the body of the garment.

The apertures 140 may be arranged in a relatively uniformly-spaced configuration which allows air infiltration at various points. The size and shape of the apertures 140 may be determined based in part on their spacing and/or aesthetic considerations. Also, the total surface area covered by the apertures 140 may be kept below a certain percentage of the total surface area of the panel, e.g., between about 6% and about 10% or, alternatively, between about 3% and about 13%, in order to prevent the panel from losing too much rigidity. Preferably, the total surface area covered by the apertures 140 is about 8%.

Figure 3B:
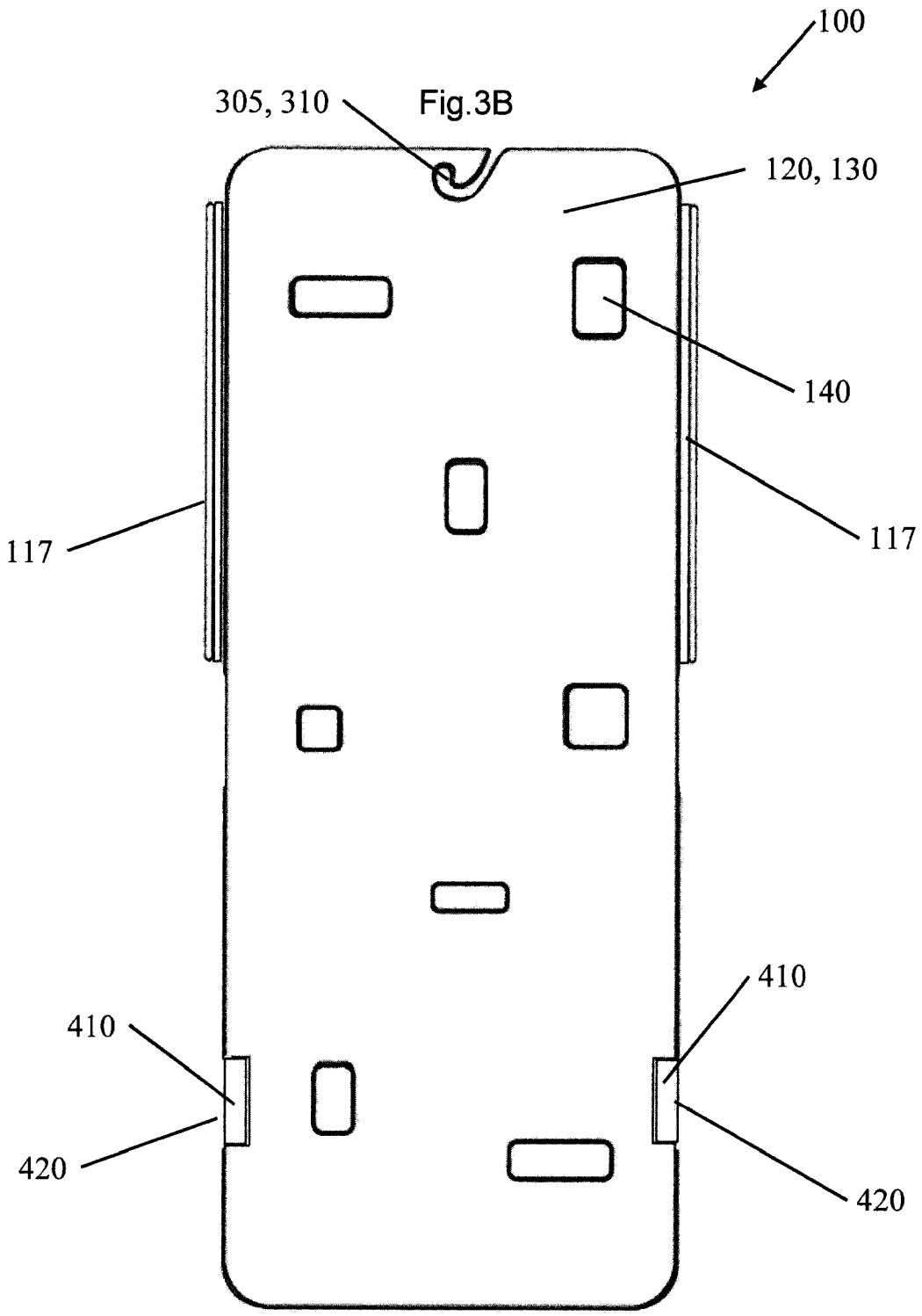
FIG. 3B is a front plan view of the garment folding apparatus in the fully folded position.

As shown in FIG. 3B, when the garment folding apparatus 100 is not in use, the side panels (120 and 130) can be both be folded onto the center panel 110 to form a more compact configuration for storage and transportation of the apparatus 100. A hanging slot 305 may be provided at a top portion of the center panel 110, with corresponding slots 310 formed in the side panels (120 and 130) (see FIGS. 1-3). The hanging slots (305 and 310) are easily formed during the production process and allow the apparatus to be hung on a projection or hook. This functionality is thus provided without requiring an element which extends from the panel, which would increase the overall size of the apparatus (e.g., for storage and/or shipping purposes) and might be susceptible to damage.

Figure 4:
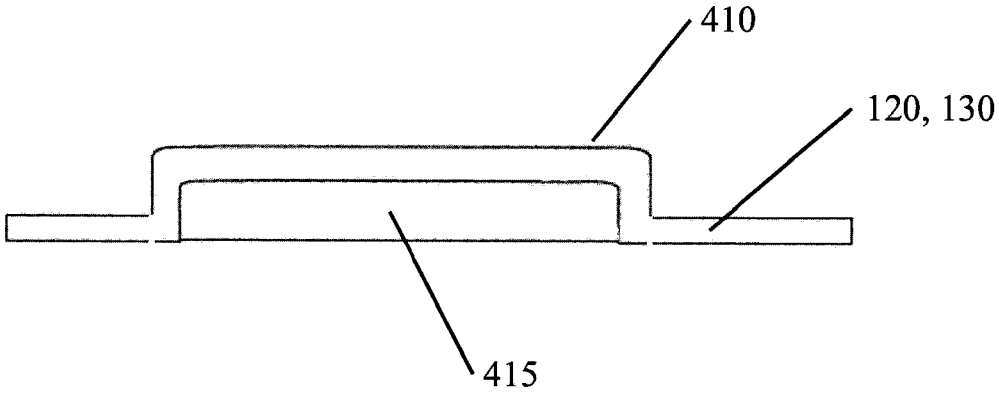
FIG. 4 is a partial side view of the garment folding apparatus showing a raised handle on an outer edge of a side panel of the apparatus.

As shown in the partial view of FIG. 4, the outer edges of the side panels (120 and 130) may include one or more raised handles 410. As an alternative, or in addition to the side edges, the handles 410 may also be formed on the top and/or bottom edges of the side panels (120 and 130) and on the bottom edge of the bottom portion 125 of the center panel 110. The handles 410 may be formed as a raised portion of the panel which extends along a portion of the outer side edge of the side panels (120 and 130). The raised portion is thus spaced above the flat surface on which the panel may be resting, whereas the remainder of the panel lies directly on the flat surface, which tends to make it more difficult to lift from the surface. The handles may be gripped by inserting one's fingers in the concave portion 415, i.e., cavity, under the raised portions of the handle 410. The side panel can thereby be easily lifted from a flat surface for the folding operation.

Figure 5:
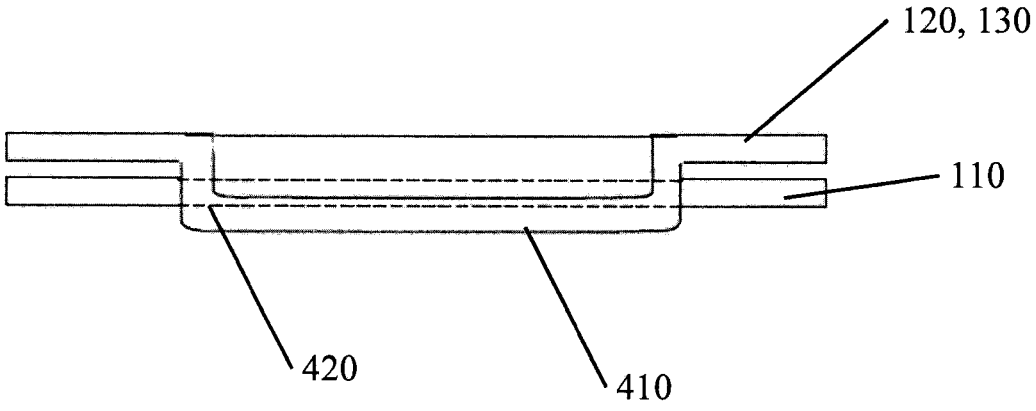
FIG. 5 is a partial side view of the garment folding apparatus in the folded position showing the raised handle of the outer edge of the side panel of the apparatus, with the raised handle received in a cut-out portion of the center panel.

Referring again to FIGS. 1 and 2, the inner edges of the side panels (120 and 130) and the outer edges of the bottom portion 125 of the center panel 110 may include opposing cut-out portions 420, i.e., notches. These cut-out portions 420 are positioned to correspond to the locations of the handles 410 on the outer edges of the side panels (120 and 130). When the side panels (120 and 130) are folded onto the center panel 110 in the storage configuration of the apparatus 100, as shown in FIG. 3B, the handles 410 fit into the cut-out portions 420, as shown in FIG. 5. This arrangement allows for the side panels (120 and 130) to lie flat against the center panel 110 in the storage configuration.

Figure 6:
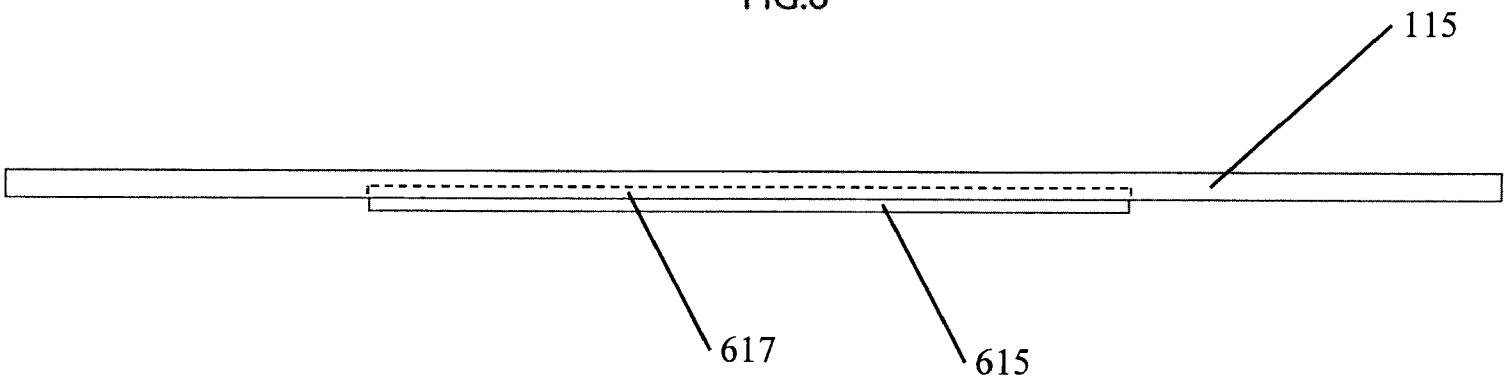
FIG. 6 is a partial view of the garment folding apparatus showing a gripping element extending from the back of the center panel.

As shown in FIG. 6, the top portion 115 of the center panel 110 may include a gripping element 615 which may be installed in a depression 617 formed in the center panel 110 and which extends from the back of the center panel 110 to elevate it from the surface on which it is used and prevent slippage of the apparatus 100 during use. The gripping element 615 may be round, rectangular, or square in shape and may be formed, e.g., of rubber.

Figure 7:
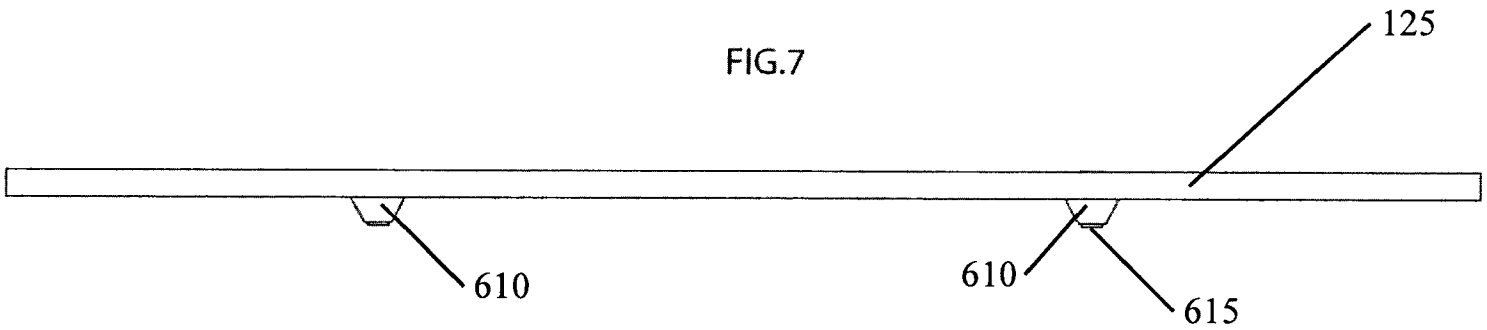
FIG. 7 is a partial view of the garment folding apparatus showing feet extending from the back of the center panel.

As shown in FIG. 7, the bottom portion 125 of the center panel 110 may include feet 610 which extend from the back thereof to elevate the center panel 110 above the surface on which it is used. The feet 610 may be, round, rectangular or square in shape and may have gripping elements 615, e.g., rubber, attached on a bottom surface thereof. The use of feet 610 on the bottom portion 125 of the center panel 110, in conjunction with the handles 410 on the outer edges of the side panels (120 and 130), can provide a uniform elevation above the working surface for the portions of the apparatus 100 which are lifted during the folding operation. This can make it easier to operate, because the user can more easily grip and lift the side panels (120 and 130) and the bottom portion 125 of the center panel 110 in order to perform the folding operation.

Although example embodiments have been shown and described in this specification and figures, it would be appreciated by those skilled in the art that changes may be made to the illustrated and/or described example embodiments without departing from their principles and spirit.

What is claimed is:

1. A garment folding apparatus having an arrangement of panels connected by hinges for receiving, across a surface of the panels, an article of clothing to be folded, the apparatus comprising:

a planar center panel having a width which is less than a length of the center panel, the center panel being formed of a first portion and a second portion joined by a first hinge configured to fold the center panel in a lengthwise direction;

a planar first side panel having a width which is less than a length of the first side panel, the first side panel being joined along an inner edge thereof to the first portion of the center panel by a second hinge, the first side panel being positioned so that a lengthwise direction thereof is parallel to the lengthwise direction of the center panel, the first side panel comprising a raised handle portion on an outer edge thereof; and a planar second side panel having a width which is less than a length of the second side panel, the second side panel being joined along an inner edge thereof to the first portion of the center panel by a third hinge, the second side panel being positioned so that a lengthwise direction thereof is parallel to the lengthwise direction of the center panel, the second side panel comprising a raised handle portion on an outer edge thereof, wherein the first and second side panels comprise a plurality of apertures formed therein to allow air to pass through as the first and second side panels are moved from a folded position to an unfolded position, and a surface area occupied by the plurality of apertures is between about 3% and about 13% of a total surface area of the first and second side panels.

2. The apparatus of claim 1, wherein the handle portions of the first and second side panels are configured so that when the first and second side panels are folded onto the center panel, the handle portions fit into corresponding notches formed in side edges of the second portion of the center panel and corresponding notches formed in inner side edges of the first and second side panels.

3. The apparatus of claim 1, wherein the handle portions extend along a portion of the outer side edges of the first and second side panels such that a cavity is formed between each of the raised handle portions and a working surface, and the handle portions are gripped by inserting one or more fingers into the cavities to lift the first and second side panels.

4. The apparatus of claim 1, wherein a surface area occupied by the plurality of apertures is between about 6% and about 10% of a total surface area of the first and second side panels.

5. The apparatus of claim 1, wherein the center panel comprises a hanging slot to allow the apparatus to be hung from a hook or projection without having an element which extends from the center panel.

6. The apparatus of claim 5, wherein the first and second side panels comprise corresponding hanging slots which align with the hanging slot of the center panel when the first and second side panels are in a folded position.

7. A garment folding apparatus having an arrangement of panels connected by hinges for receiving, across a surface of the panels, an article of clothing to be folded, the apparatus comprising:

a planar center panel having a width which is less than a length of the center panel, the center panel being formed of a first portion and a second portion joined by a first hinge configured to fold the center panel in a lengthwise direction;

a planar first side panel having a width which is less than a length of the first side panel, the first side panel being joined along an inner edge thereof to the first portion of the center panel by a second hinge, the first side panel being positioned so that a lengthwise direction thereof is parallel to the lengthwise direction of the center panel, the first side panel comprising a raised handle portion on an outer edge thereof; and a planar second side panel having a width which is less than a length of the second side panel, the second side panel being joined along an inner edge thereof to the first portion of the center panel by a third hinge, the second side panel being positioned so that a lengthwise direction thereof is parallel to the lengthwise direction of the center panel, the second side panel comprising a raised handle portion on an outer edge thereof, wherein the top portion of the center panel comprises a gripping element positioned in a depression formed in the center panel and which extends from the back of the center panel to elevate the center panel from a working surface and prevent slippage of the apparatus during use.

8. The apparatus of claim 7, wherein the gripping element is round, rectangular, or square in shape and is formed of rubber.

9. The apparatus of claim 1, wherein the bottom portion of the center panel comprises feet which extend from the back thereof to elevate the center panel above a working surface.

10. The apparatus of claim 9, wherein the feet are round, rectangular, or square in shape and comprise gripping elements attached on a bottom surface thereof.

11. The apparatus of claim 9, wherein the feet on the bottom portion of the center panel, in conjunction with the handles on the outer edges of the first and second side panels, provide a uniform elevation above a working surface for portions of the apparatus which are lifted during the folding operation.

* * * * *